US009583286B2

(12) United States Patent
Mau

(10) Patent No.: US 9,583,286 B2
(45) Date of Patent: Feb. 28, 2017

(54) SWITCH CARRIER WITH ONE CONTACT POINT WITH A SWITCH INCLUDING SECOND CONTACT POINT

(71) Applicants: LITE-ON ELECTRONICS (GUANGZHOU) LIMITED, Guangzhou (CN); LITE-ON TECHNOLOGY CORP., Taipei (TW)

(72) Inventor: Shu-Hua Mau, Taipei (TW)

(73) Assignees: Lite-On Electronics (Guangzhou) Limited, Guangzhou (CN); Lite-On Technology Corp., Taipei (TW)

( * ) Notice: Subject to any disclaimer, the term of this patent is extended or adjusted under 35 U.S.C. 154(b) by 34 days.

(21) Appl. No.: 14/837,311

(22) Filed: Aug. 27, 2015

(65) Prior Publication Data

US 2016/0293353 A1 Oct. 6, 2016

(30) Foreign Application Priority Data

Apr. 2, 2015 (CN) ..... 2015 2 0197544 U

(51) Int. Cl.
*H01H 1/64* (2006.01)
*H01H 13/14* (2006.01)
*H01H 13/04* (2006.01)

(52) U.S. Cl.
CPC ..... *H01H 13/14* (2013.01); *H01H 13/04* (2013.01); *H01H 2205/002* (2013.01)

(58) Field of Classification Search
CPC ..... H01H 13/00; H01H 13/02; H01H 13/20; H01H 13/183
USPC ... 200/293, 16 B, 520, 341, 447, 50.1, 52 R, 200/61.81
See application file for complete search history.

(56) References Cited

U.S. PATENT DOCUMENTS 3,819,891 A * 6/1974 Miller ..... H01H 13/38 200/302.2
4,150,371 A * 4/1979 Scaglione ..... G08B 13/06 200/61.81
4,316,065 A * 2/1982 Rupp ..... H01H 3/166 188/1.11 L
4,401,867 A * 8/1983 Grunst ..... H01H 3/001 200/243
5,410,115 A * 4/1995 Hizume ..... H01H 13/18 200/16 B

* cited by examiner

*Primary Examiner* — Vanessa Girardi
(74) *Attorney, Agent, or Firm* — Rosenberg, Klein & Lee

(57) ABSTRACT

An electronic apparatus includes a housing having first and second cover bodies covering opposite first and second ends thereof, and a switch device including a support member, and a switch assembly mounted on and slidable relative to the support member and having first and second contact points. When one of the first and second cover bodies covers one of the ends of the housing and pushes one of the first and second contact points with the other one of the first and second contact points being unblocked, the switch assembly is placed in an OFF state. When the first and second cover bodies cover the ends of the housing and push the first and second contact points toward each other, the switch assembly is switched from the OFF state to an ON state.

27 Claims, 11 Drawing Sheets

SWITCH CARRIER WITH ONE CONTACT POINT WITH A SWITCH INCLUDING SECOND CONTACT POINT

CROSS-REFERENCE TO RELATED APPLICATION

This application claims priority to Chinese Application No. 201520197544.1, filed on Apr. 2, 2015.

FIELD

The disclosure relates to an electronic apparatus, more particularly to a switch assembly which can be moved in two different directions so as to be switchable between ON and OFF states, a switch device having the switch assembly, and an electronic apparatus having the switch device.

BACKGROUND

A circuit board of an existing electronic apparatus has a built-in power supply unit. A repair person may decide at his discretion whether to turn ON or OFF the power supply unit by controlling a conventional switch. When the switch is operated to put the power supply unit in an ON state, the circuit board is energized. When the switch is operated to put the power supply unit in an OFF state, the circuit board is de-energized. At this time, the repair person can inspect, repair or replace the electronic components on the circuit board.

However, the repair person can only press a pushbutton of the switch in a single direction, so that the switch cannot be used on an electronic apparatus that requires movement of the switch in different directions. Hence, the use of the conventional switch is relatively limited.

SUMMARY

Therefore, an object of the disclosure is to provide an electronic apparatus that can enhance the safety of operation and use thereof through a switch assembly which can be moved in two different directions so as to be switchable between ON and OFF states.

Accordingly, an electronic apparatus of the disclosure includes a housing and a switch device.

The housing includes a first cover body for covering a first end thereof, and a second cover body opposite to the first cover body for covering a second end of the housing which is opposite to the first end. The switch device is disposed in the housing, and includes a support assembly and a switch assembly. The support assembly includes a support member. The switch assembly is mounted on and slidable relative to the support member, and has a sliding portion slidably connected to the support member, a first contact point pushable by the first cover body, and a second contact point opposite to the first contact point and pushable by the second cover body. The switch assembly is slidable relative to the support assembly in a first direction and a second direction opposite to the first direction, and is switchable between OFF and ON states. When the first cover body covers the first end of the housing and pushes the first contact point to move along the first direction with the second contact point being unblocked, or when the second cover body covers the second end of the housing and pushes the second contact point to move along the second direction with the first contact point being unblocked, the switch assembly is placed in the OFF state. When the first and second cover bodies respectively and simultaneously cover the first end and the second end of the housing, the first and second contact points are pushed toward each other to switch the switch assembly from the OFF state to the ON state.

Another object of the disclosure is to provide a switch device of an electronic apparatus that can enhance the safety of operation and use thereof through a switch assembly which can be moved in two different directions so as to be switchable between ON and OFF states.

Still another object of the disclosure is to provide a switch device of an electronic apparatus that has few components and a simple structure, and that is easy to assemble, so that the manufacturing cost and the assembly time thereof can be significantly reduced, and the convenience of assembly thereof can be significantly enhanced.

Accordingly, a switch device of the electronic apparatus of the disclosure includes a support assembly and a switch assembly. The electronic apparatus includes opposite first and second cover bodies.

The support assembly includes a support member. The switch assembly is mounted on and slidable relative to the support member and has a sliding portion slidably connected to the support member, a first contact point configured to be pushed by the first cover body, and a second contact point opposite to the first contact point and configured to be pushed by the second cover body. The switch assembly is slidable relative to the support assembly in a first direction and a second direction opposite to the first direction, and is switchable between OFF and ON states. When the first contact point is pushed by the first cover body to move along the first direction with the second contact point being unblocked, or when the second contact point is pushed by the second cover body to move along the second direction with the first contact point being unblocked, the switch assembly is placed in the OFF state. When the first and second contact points are respectively and simultaneously pushed by the first and second cover bodies, the first and second contact points are pushed toward each other to switch the switch assembly from the OFF state to the ON state.

A further object of the disclosure is to provide a switch assembly of a switch device that can be moved in two different directions so as to be switchable between ON and OFF states.

A still further object of the disclosure is to provide a switch assembly of a switch device that has few components and a simple structure, and that is easy to assemble, so that the manufacturing cost and the assembly time thereof can be significantly reduced, and the convenience of assembly thereof can be significantly enhanced.

Accordingly, the switch assembly of the switch device of the disclosure includes a carrier and a switch. The carrier includes a sliding portion and a first contact point. The switch is disposed on the carrier and includes a second contact point opposite to the first contact point. The switch is movable along with the carrier in a first direction and a second direction opposite to the first direction. The switch assembly is placed in an OFF state when the first and second contact points are moved away from each other, and is switched from the OFF state to an ON state when the first and second contact points are moved toward each other.

The advantages of the disclosure reside in that, through the switch assembly of the switch device which can be moved in two different directions so as to be switchable between ON and OFF states, the safety of operation and use thereof can be enhanced. In addition, since the switch assembly and the switch device have few components and a simple structure, and are easy to assemble, the manufacturing cost and the assembly time thereof can be significantly reduced, and the convenience of assembly thereof can be significantly enhanced.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
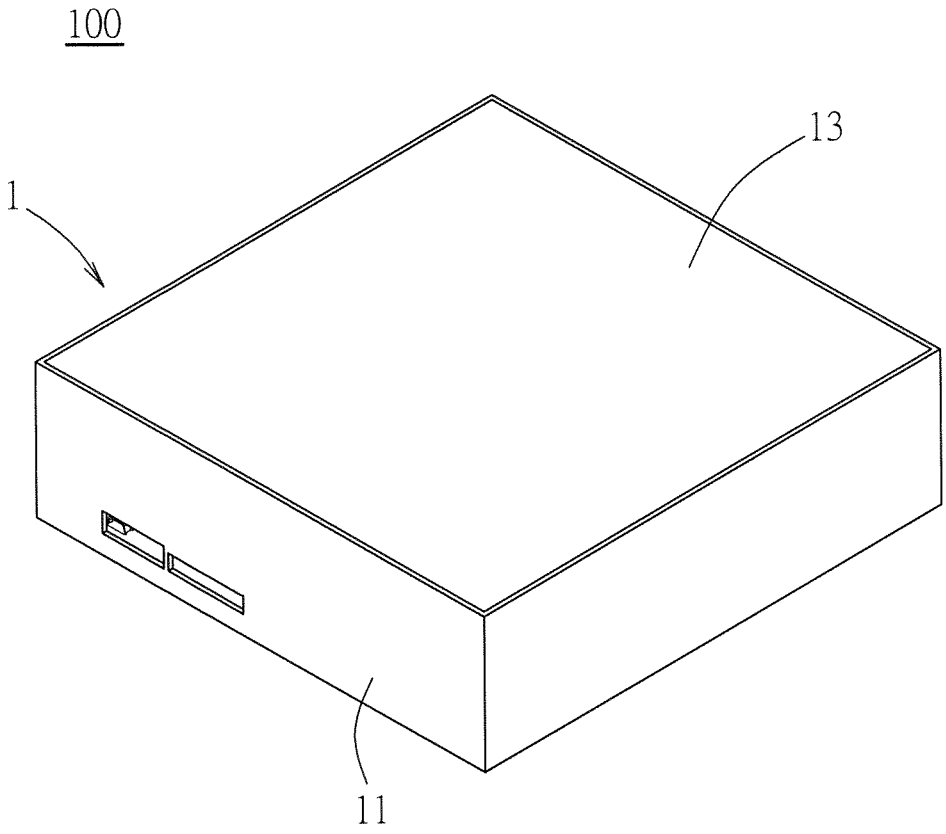
FIG. 1 is a perspective view of an embodiment of an electronic apparatus according to the disclosure.
Figure 2:
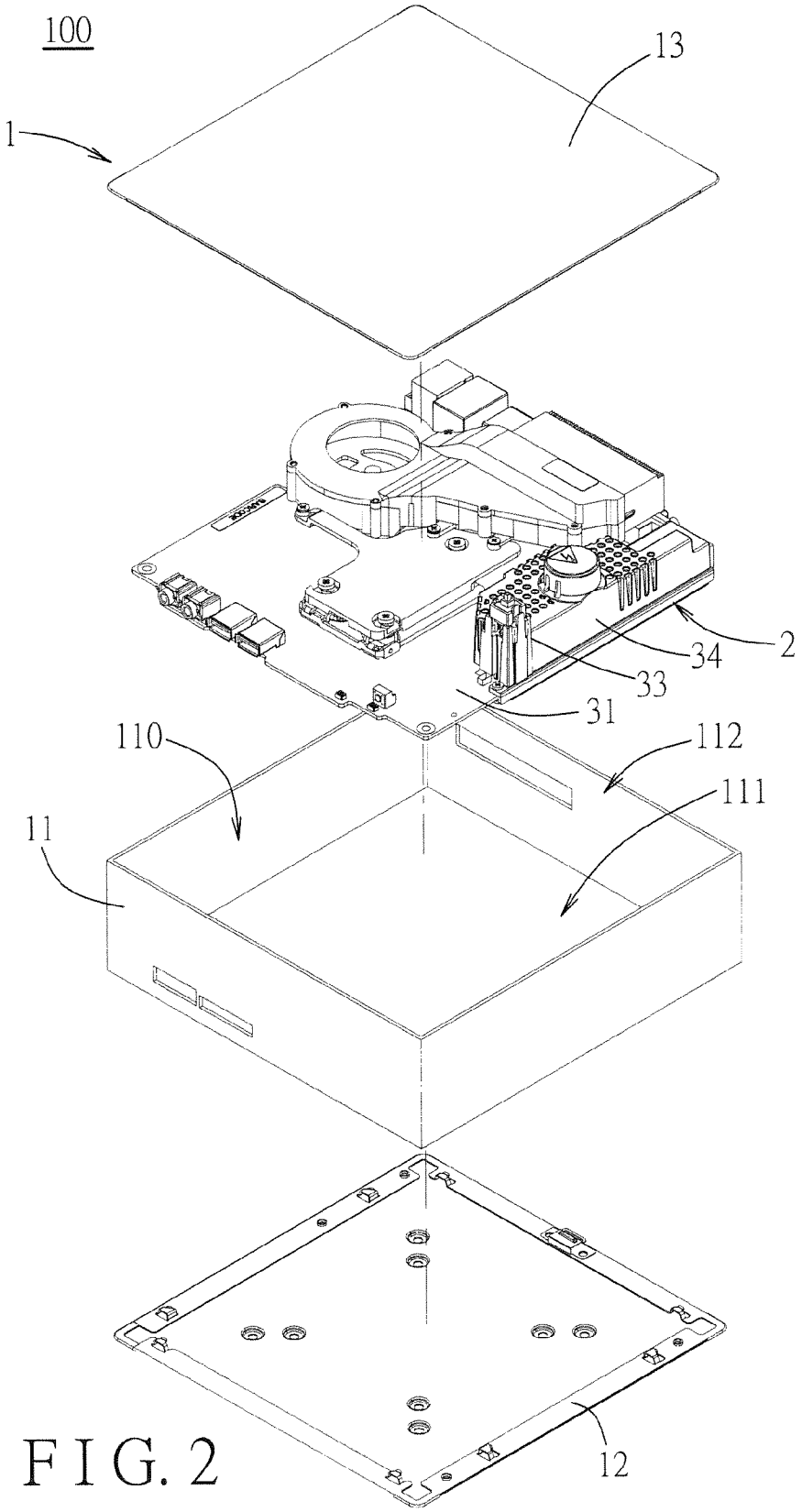
FIG. 2 is an exploded perspective view of the embodiment.

Referring to FIGS. 1 and 2, an embodiment of an electronic apparatus 100 according to the present disclosure is shown to include a housing 1 and a switch device 2. In this embodiment, the electronic apparatus 100 is exemplified as a computer body.

The housing 1 includes a frame 11, a first cover body 12 and a second cover body 13. The frame 11 has opposite first and second ends, and defines a receiving space 110, a first opening 111 at the first end for communicating the receiving space 110 with an outside environment, and a second opening 112 at the second end for communicating the receiving space 110 with the outside environment. The first cover body 12 is disposed on the first end to close the first opening 111, and the second cover body 13 is disposed on the second end to close the second opening 112, so that the frame 11 is disposed between the first and second cover bodies 12, 13. Each of the first and second cover bodies 12, 13 is secured to a respective one of the first and second ends of the frame 11 by using a hook and groove engaging method or a screw fastening method.

Figure 3:
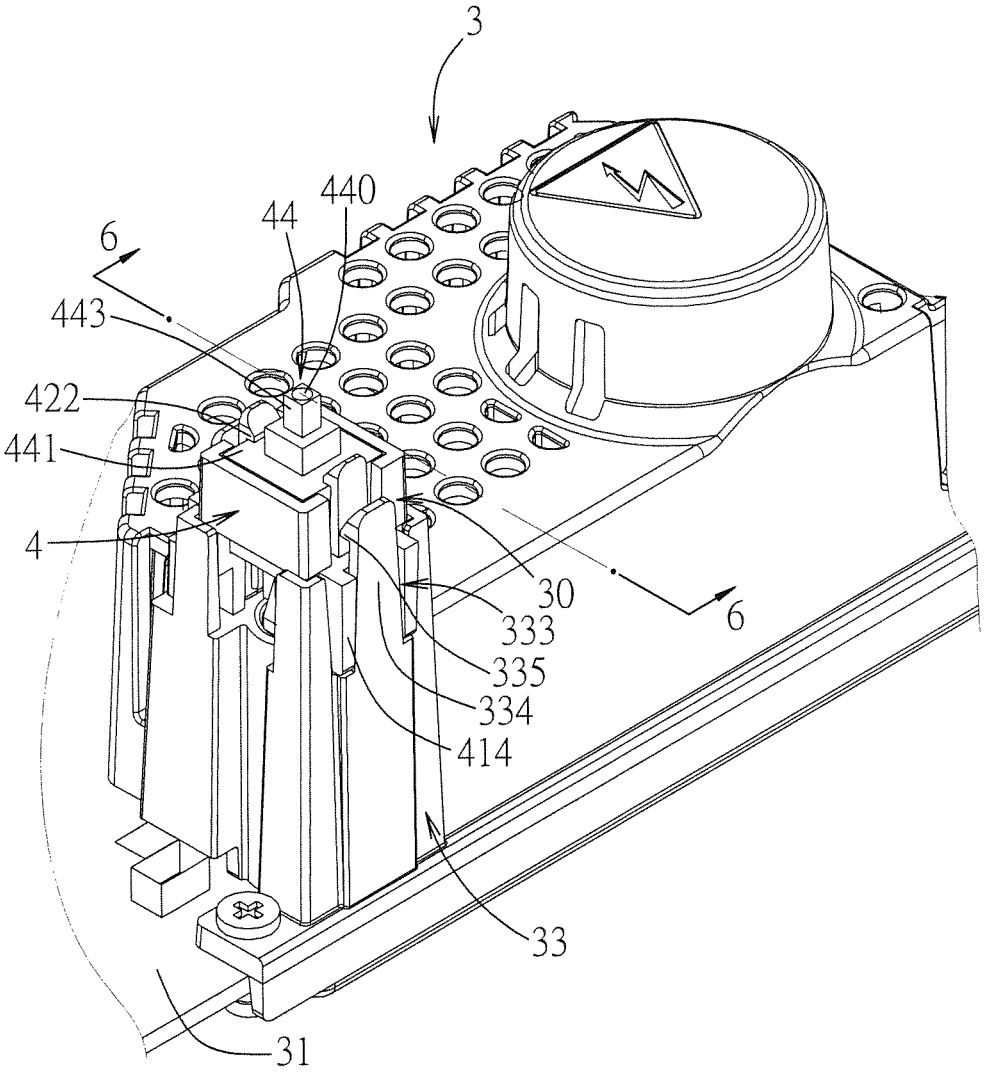
FIG. 3 is an enlarged fragmentary perspective view of FIG. 2, illustrating an assembly relationship between a support assembly and a switch assembly of the embodiment.
Figure 4:
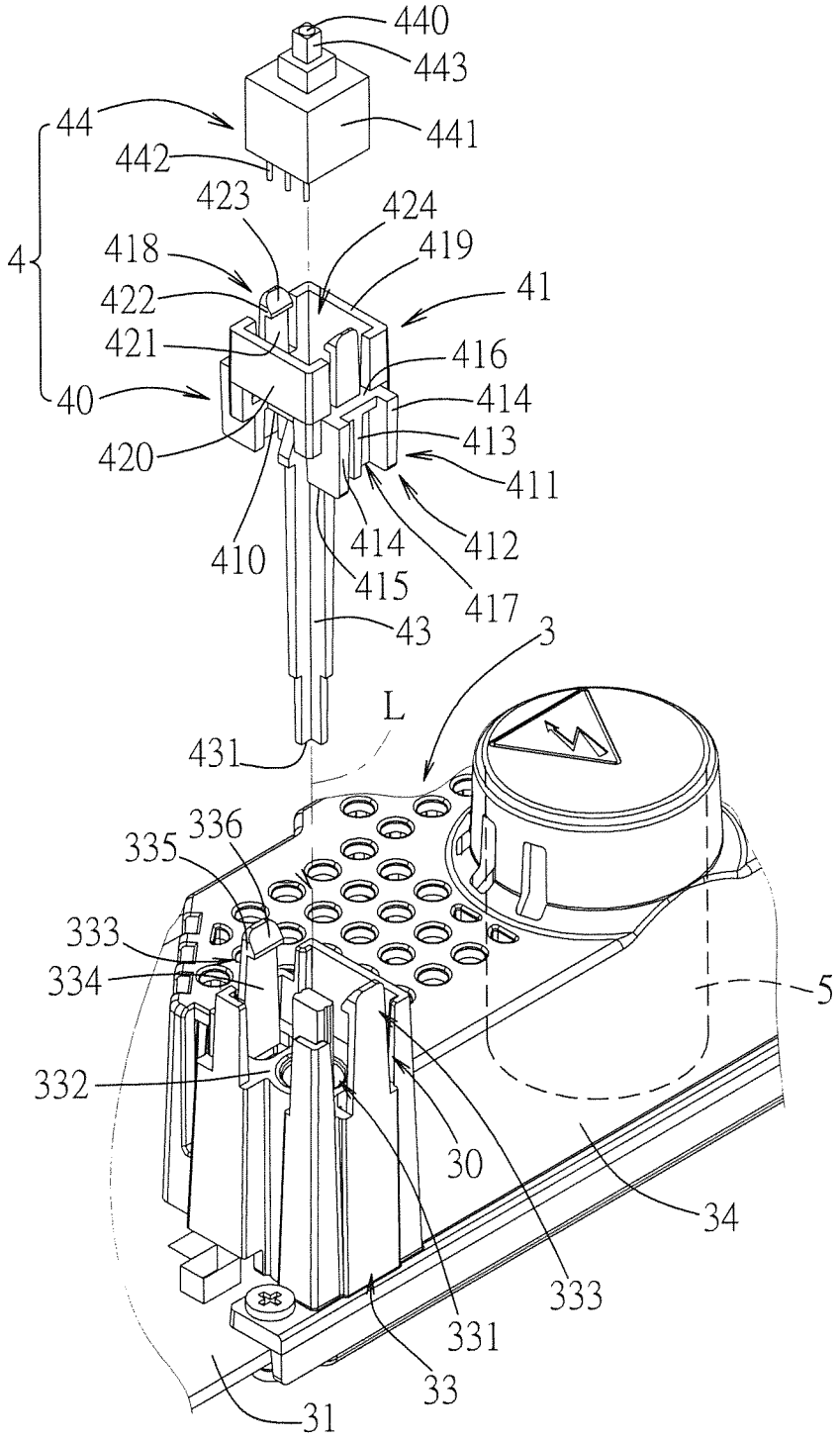
FIG. 4 is an exploded perspective view of FIG. 3.
Figure 5:
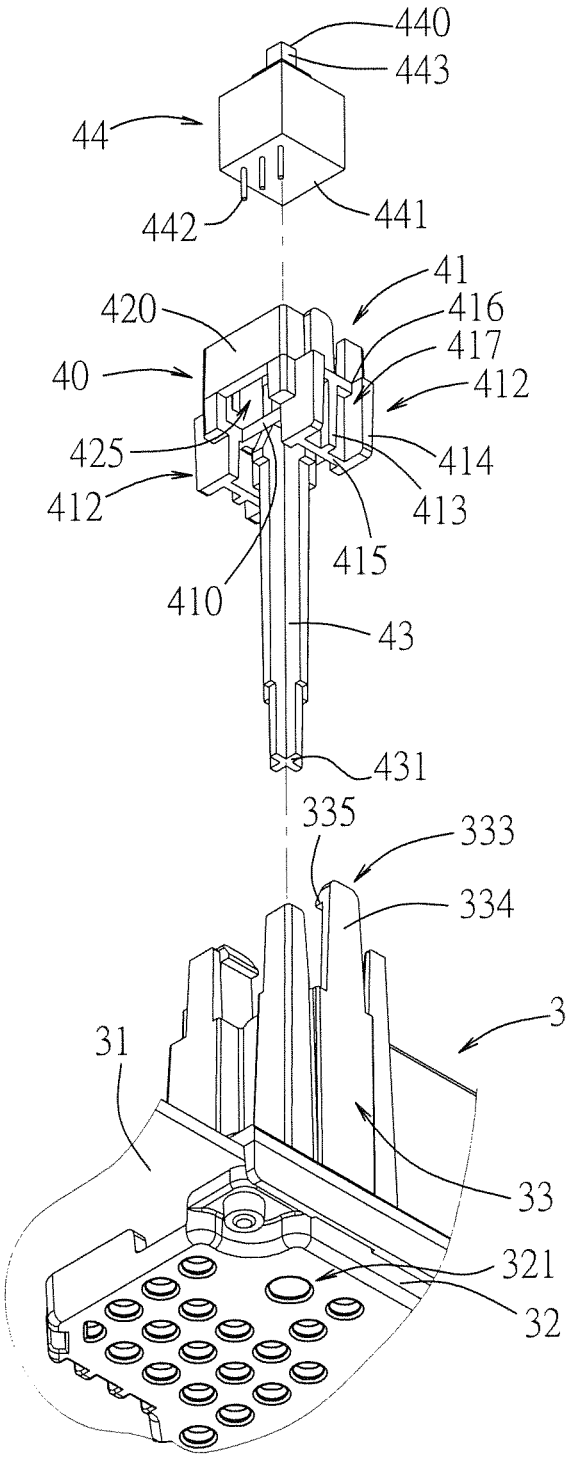
FIG. 5 is a view similar to FIG. 4, but taken from a different angle.
Figure 7:
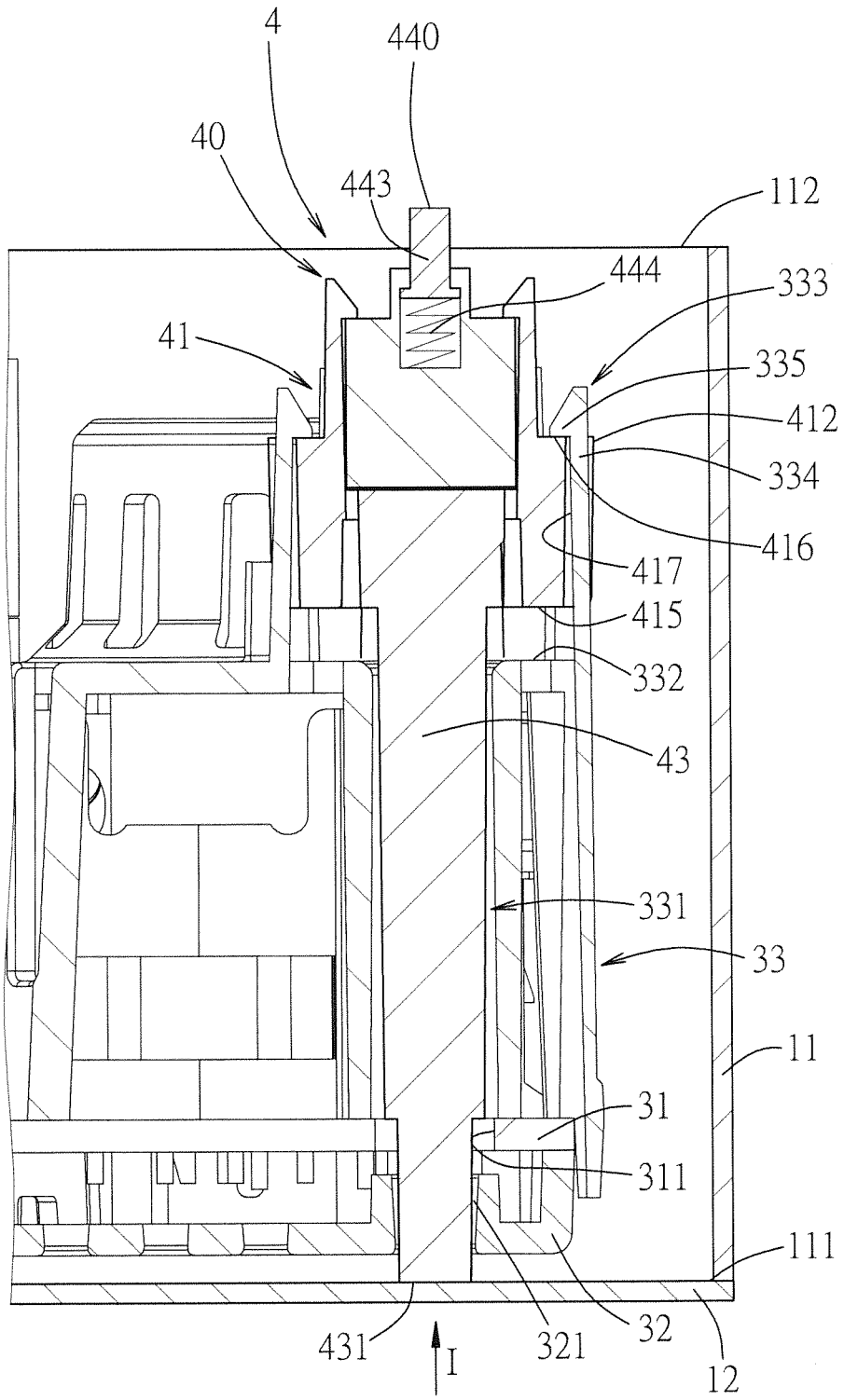
FIG. 7 is an enlarged fragmentary sectional view of the embodiment, illustrating a first cover body pushing a first contact point to move the switch assembly along a first direction to a second position.
Figure 8:
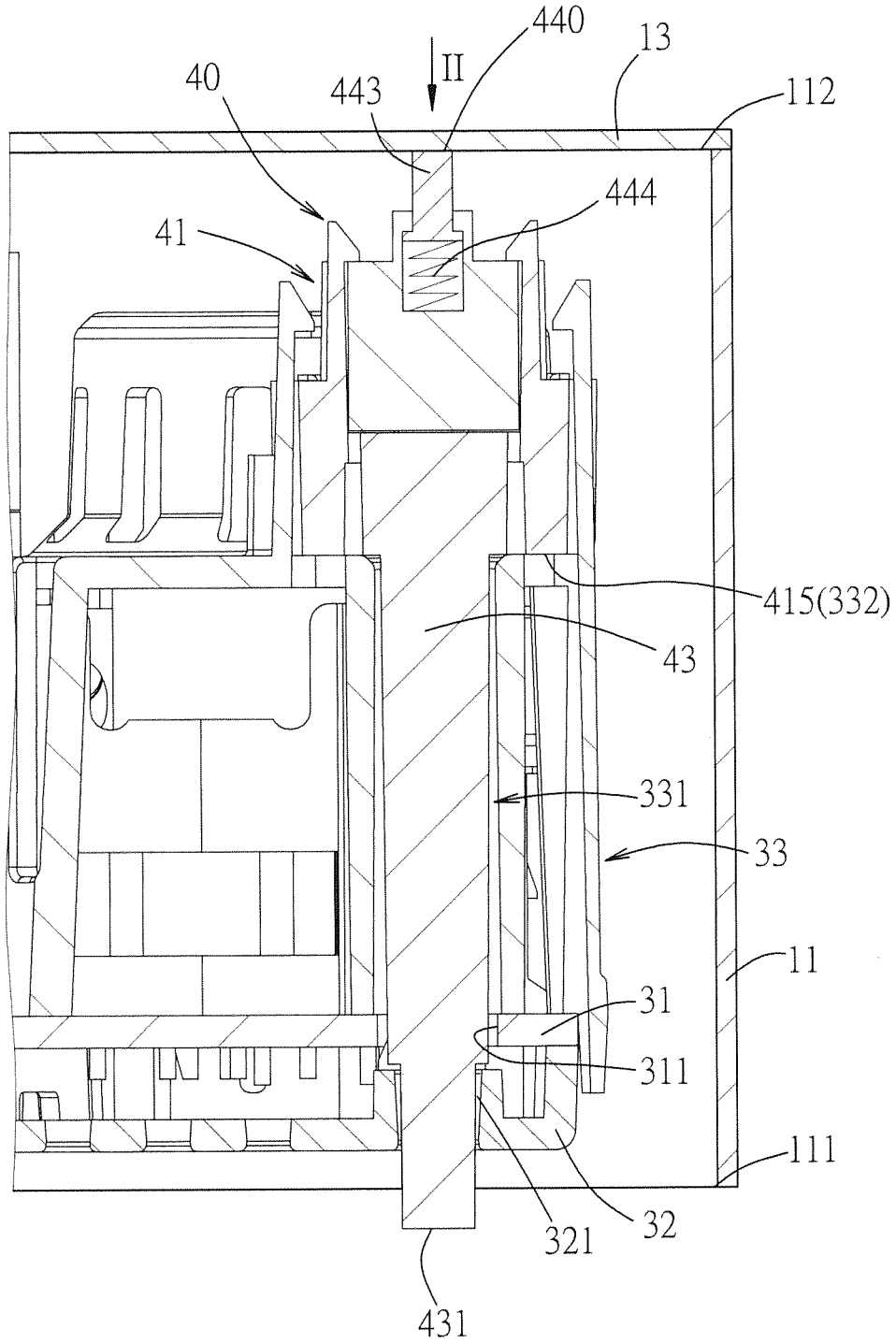
FIG. 8 is another enlarged fragmentary sectional view of the embodiment, illustrating a second cover body pushing a second contact point to move the switch assembly along a second direction to the first position.
Figure 9:
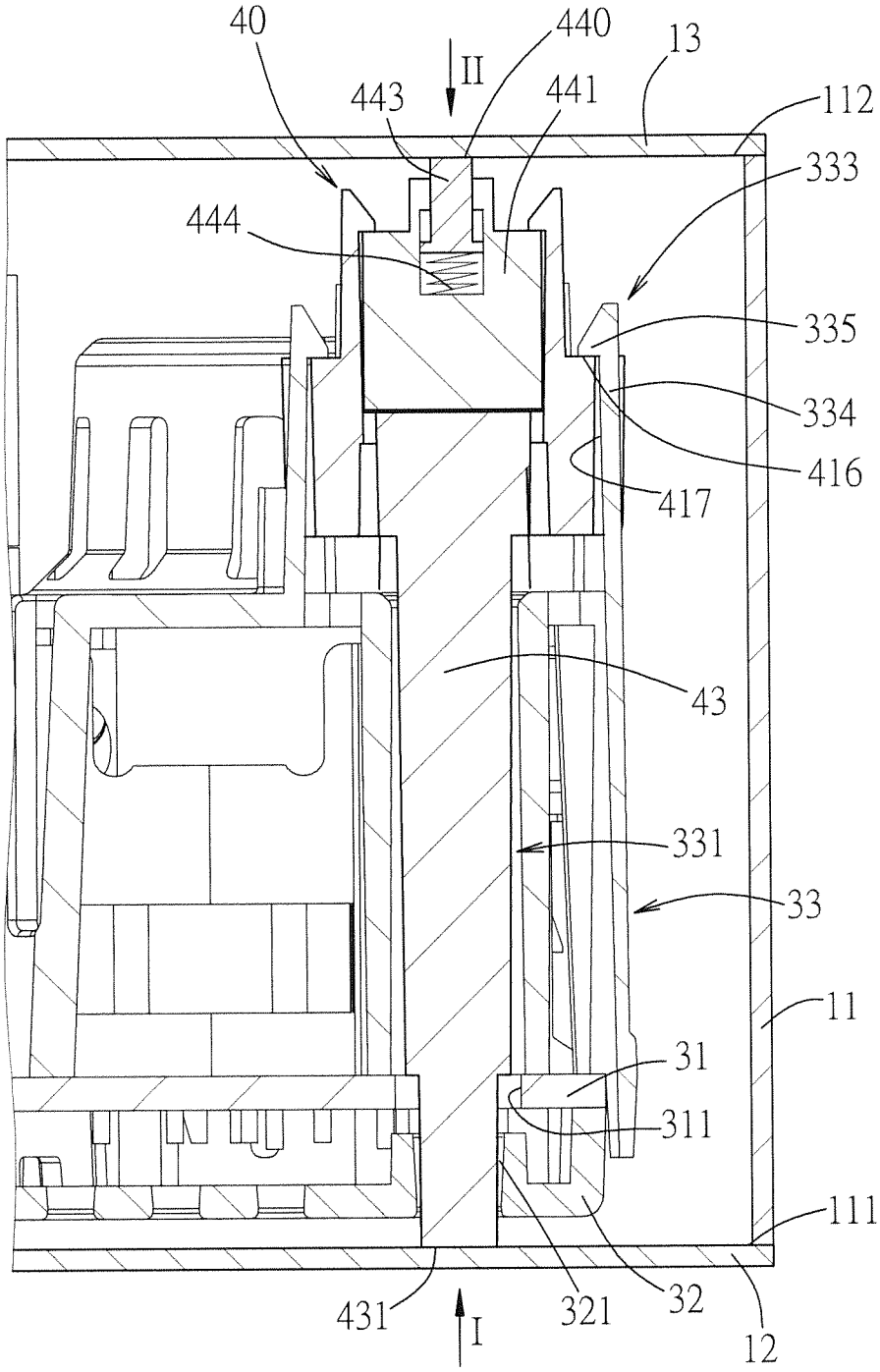
FIG. 9 is still another enlarged fragmentary sectional view of the embodiment, illustrating the first and second cover bodies respectively pushing the first and second contact points to move the switch assembly to the second position and the pushbutton of the switch to a pressed position.

Referring to FIGS. 3 to 5, in combination with FIG. 2, the switch device 2 is received in the receiving space 110, and includes a support assembly 3 and a switch assembly 4. The support assembly 3 includes a support member 30 and a circuit board 31. The switch assembly 4 is mounted on and slidable relative to the support member 3, and includes a carrier 40 and a switch 44. The carrier 40 includes a carrier body 41 and a column 43 projecting from one end of the carrier body 41. The carrier body 41 includes a sliding portion 411 slidably connected to the support member 30. The column 43 has a first contact point 431 pushable by the first cover body 12. The switch 44 is disposed on the carrier 40, and has a second contact point 440 opposite to the first contact point 431 and pushable by the second cover body 13. The switch assembly 4 is slidable relative to the support assembly 3 in a first direction (I), as shown in FIG. 7, and a second direction (II) opposite to the first direction (I), as shown in FIG. 8, and is switchable between an OFF state, as shown in FIG. 6, and an ON state, as shown in FIG. 9.

When the first cover body 12 covers the first end of the frame 11 and pushes the first contact point 431 to move along the first direction (I) with the second contact point 440 being unblocked, or when the second cover body 13 covers the second end of the frame 11 and pushes the second contact point 440 to move along the second direction (II) with the first contact point 431 being unblocked, the switch assembly 4 is placed in the OFF state, and the circuit board 31 of the support assembly 3 is de-energized. At this time, occurrence of electric shock is prevented, so that a repair person can safely inspect, repair or replace the electronic components on the circuit board 31. When the first and second cover bodies 12, 13 respectively and simultaneously cover the first and second ends of the frame 11, the first and second contact points 431, 440 are pushed toward each other to switch the switch assembly 4 from the OFF state to the ON state. In this time, the circuit board 31 is energized so that the electronic components thereon can be operated.

Since the switch assembly 4 can be slidably moved in two different directions, whether the first cover body 12 or the second cover body 13 is first assembled to the frame 11, the switch assembly 4 remains in the OFF state. When the first and second cover bodies 12, 13 are both assembled to the frame 11, the switch assembly 4 is switched from the OFF state to the ON state. In addition, whether the first or the second cover body 12, 13 is first disassembled from the frame 11, as long as the first or the second contact point 431, 440 is unblocked, the switch assembly 4 is switched from the ON state to the OFF state. In this time, the repair person can inspect, repair or replace the electronic components on the circuit board 31. Through this, the safety of operation is enhanced, so that the repair person can safely assemble or disassemble the first and second cover bodies 12, 13. Further, operation of the switch assembly 4 is flexible, so that it is applicable to an electronic apparatus which have first and second cover bodies that are openable.

Figure 6:
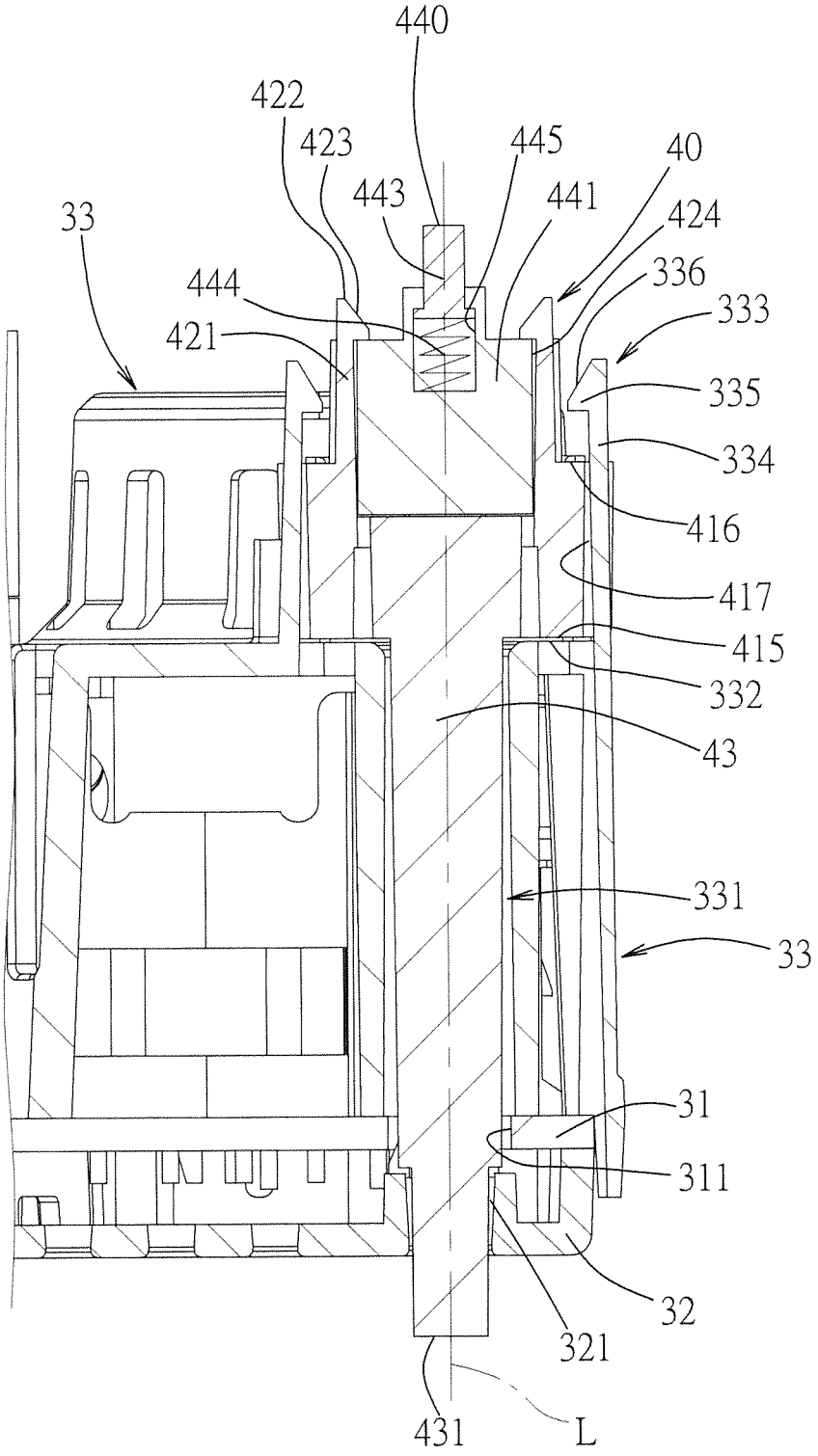
FIG. 6 is a sectional view of the embodiment taken along line 6-6 of FIG. 3, illustrating the switch assembly in a first position and an OFF state, and a pushbutton of a switch in an initial position.

Referring to FIG. 6, in combination with FIGS. 3 to 5, the support member 30 defines a longitudinal axis (L) which is parallel to the first and second directions (I, II), and includes a support base 33 disposed on a top surface of the circuit board 31 and having an abutment surface 332, and an axially extending guide hole 331 extending through the abutment surface 332. The support assembly 3 further includes a bottom cover 32 disposed on a bottom surface of the circuit board 31, and a casing 34 disposed on the top surface of the circuit board 31 and adjacently connected to the support base 33. The bottom cover 32 and the support base 33 are secured to the circuit board 31, for example, by means of screws. The circuit board 31 is formed with a through hole 311 communicating with the guide hole 331. The bottom cover 32 is formed with a through hole 321 in communication with the through hole 311 of the circuit board 31. The column 43 is inserted into the axially extending guide hole 331, the through hole 311 and the through hole 321 to extend the first contact point 431 out of the support base 33 and the bottom cover 32, so that the first contact point 431 is pushable by the first cover body 12.

It should be noted that, though the support assembly 3 in this embodiment is exemplified as including the circuit board 31, the bottom cover 32 and the support member 30, it is not limited to this disclosure. In other embodiments, the support assembly 3 may only include the circuit board 31 and the support member 30 for supporting the switch assembly 4, or the support assembly 3 may only include the support member 30 for supporting the switch assembly 4.

The electronic apparatus 100 further includes a power supply unit 5 disposed on the top surface of and electrically coupled to the circuit board 31 for supplying the electrical power to the electronic components on the circuit board 31. The casing 34 covers the power supply unit 5. The support member 30 further includes two retaining hooks 333 disposed on two opposite sides of the abutment surface 332 such that the axially extending guide hole 331 is disposed between the retaining hooks 333. Each of the retaining hooks 333 has an elongated guide arm portion 334 projecting upward from a respective one of the two opposite sides of the abutment surface 332, and a hook end 335 formed on a terminal end of the guide arm portion 334. The guide arm portions 334 of the retaining hooks 333 are elongated in a direction parallel with the first direction (I) (see FIG. 7) and the second direction (II) (see FIG. 8). The hook end 335 of each retaining hook 333 has an inclined guide surface 336 extending downwardly, inwardly and inclinedly from the terminal end of the guide arm portion 334 of a respective retaining hook 333. The inclined guide surfaces 336 of the hook ends 335 face each other.

In this embodiment, the carrier 40 is made, for example, by injection molding. The carrier body 41 of the carrier 40 further includes a base wall 410 supporting the switch 44. The column 43 projects from a bottom surface of the base wall 410. The sliding portion 411 includes two sliding blocks 412 respectively formed on two opposite sides of the base wall 410, so that the inclined guide surfaces 336 of the hook ends of the retaining hooks 333 can respectively abut and guide the sliding blocks 412 during mounting of the switch assembly 4 to the support member 30. Each of the sliding blocks 412 has a main wall 413 connected to the base wall 410, two sliding walls 414 formed respectively on two opposite ends of the main wall 413, a first end surface 415 connected to bottom edges of the main wall 413 and the sliding walls 414, and a second end surface 416 opposite to the first end surface 415 and connected to top edges of the main wall 413 and the sliding walls 414. The main wall 413 and the sliding walls 414 cooperatively define an elongated sliding groove 417 between the first and second end surfaces 415, 416. The sliding grooves 417 of the sliding blocks 412 are elongated in the direction parallel with the first and second directions (I, II). The sliding groove 417 of each of the sliding blocks 412 slidably receives the guide arm portion 334 of a respective one of the retaining hooks 333 when the switch assembly 4 is assembled to the support member 30. By cooperation of the guide arm portion 334 of each retaining hook 333 and the sliding groove 417 of a respective sliding block 412, the sliding direction of the carrier 40 is limited. That is, the carrier 40 can only slidably move along the first direction (I) from a first position (see FIG. 6) to a second position (see FIG. 7), or along the second direction (II) from the second position to the first position. In the first position, the first end surfaces 415 of the sliding blocks 411 abut against the abutment surface 332. In the second position, the first end surfaces 415 are away from the abutment surface 332.

The carrier body 41 further includes two positioning hooks 418, a first surrounding wall 419 and a second surrounding wall 420. Each of the positioning hooks 418 includes a positioning arm portion 421 protruding from the second end surface 416 of a respective one of the sliding blocks 412, and a positioning hook end 422 formed on a terminal end of the positioning arm portion 421. The positioning hook end 422 of each positioning hook 418 has an inclined surface 423 for abutting and guiding the switch 44 during mounting of the switch on the carrier 40. The inclined surfaces 423 of the positioning hook ends 422 of the positioning hooks 418 face each other. The first surrounding wall 419 is connected to the base wall 410 and the sliding blocks 412. The second surrounding wall 420 is connected to the sliding blocks 412 opposite to the first surrounding wall 419 and spaced apart from the base wall 410. The first and second surrounding walls 419, 420 are respectively disposed on the other two opposite sides of the base wall 410. The base wall 410, the sliding blocks 412, and the first and second surrounding walls 419, 420 cooperatively define a receiving groove 424 for receiving the switch 44. The base wall 410, the sliding blocks 412, and the second surrounding wall 420 cooperatively define an opening 425 communicating with the receiving groove 424.

In this embodiment, the switch 44 is a pushbutton switch that includes a switch body 441, a transmission line 442 connected to a bottom end of the switch body 441, a pushbutton 443 and a spring 444. The switch body 441 has a sliding groove 445 (see FIG. 6) extending inwardly from a top surface thereof and having an opening that faces upward. The pushbutton 443 is partially inserted into the sliding groove 445 and partially protrudes out of the top surface of the switch body 441. Further, the pushbutton 443 has the second contact point 440 disposed on a top end thereof which is located outwardly of the sliding groove 445. The first and second contact points 431, 440 are spaced apart from each other when the switch assembly 4 is in the OFF state. The pushbutton 443 is slidable relative to the switch body 441 along the sliding groove 445 between an initial position (see FIG. 6) and a pressed position (see FIG. 9). The spring 444 is a compression spring that is disposed in the sliding groove 445 to bias the pushbutton 443 away from the first contact point 431 for maintaining the pushbutton 443 in the initial position and the switch assembly 4 in the OFF state.

To assemble the switch 44 to the carrier body 41 of the carrier 40, the switch body 441 of the switch 44 is first aligned with the receiving groove 424 of the carrier body 41, after which the switch 44 is moved down toward the receiving groove 424. When the switch body 441 abuts against the inclined surfaces 423 of the hook ends 422 of the positioning hooks 418, the switch body 441 will push the inclined surfaces 423 to move away from each other so as to deform the positioning arm portions 421 of the positioning hooks 418 and store a restoring force. When the switch body 441 abuts against the base wall 410, it is stopped from moving downward, and by the restoring force of the positioning arm portions 421, the positioning hooks 418 are restored to their original position and the hook ends 422 of the positioning hooks 418 abuttingly engage the top end of the switch body 441. With the abutment of the switch body 441 against the base wall 410 and with the hook ends 422 of the positioning hooks 418 engaged with the top end of the switch body 441, the switch body 441 is prevented from moving in a top-bottom direction. Further, since two opposite sides of the switch body 441 are respectively stopped by the positioning arm portions 421 of the positioning hooks 418, and the other two opposite sides thereof are respectively stopped by the first and second surrounding walls 419, 420, the switch body 441 is prevented from moving in a left-right direction and a front-rear direction. Through the aforesaid structural design, the switch 44 can be stably positioned in the receiving groove 424 of the carrier body 41.

When the switch 44 is positioned in the receiving groove 424, the transmission line 442 extends out of the receiving groove 424 through the opening 425 so that one end of the transmission line 442 can be electrically connected to the power supply unit 5. Through this, the transmission line 442 can transmit a control signal to the power supply unit 5 for controlling the power supply unit 5 to supply electrical power to the circuit board 31 or not.

On the other hand, to assemble the switch assembly 4 to the support member 30, the column 43 of the carrier 40 is first aligned with the axially extending guide hole 331 of the support base 33, and the sliding grooves 417 of the sliding blocks 412 are also aligned with the retaining hooks 333. Afterwards, the carrier 40 together with the switch 44 is moved down to insert the column 43 into the guide hole 331. During the downward movement of the carrier 40, when the main walls 413 of the sliding blocks 412 abut against the respective inclined guide surfaces 336 of the hook ends 335 of the retaining hooks 333, the main walls 413 will push the inclined guide surfaces 336 to move away from each other so as to deform the guide arm portions 334 of the retaining hooks 333 and store a restoring force. As the main walls 413 move past the hook ends 335 of the retaining hooks 333, the guide arm portions 334 of the retaining hooks 333 are respectively received in the sliding grooves 417 of the sliding blocks 412 by the restoring force thereof, and the hook ends 335 of the retaining hooks 333 are located spaced apart from and above the respective second end surfaces 416 of the sliding blocks 412. When the carrier 40 is continuously moved down until the first end surface 415 of each sliding block 412 abuts against the abutment surface 332 of the support member 30, the carrier 40 is stopped from moving, and the column 43 extends through the guide hole 331, the through hole 311 and the through hole 321, so that the first contact point 431 protrudes out of the bottom cover 32. Thus, the assembly of the switch assembly 4 to the support member 30 is completed.

Since the support assembly 3 and the switch assembly 4 of this embodiment have few components and a simple structure, the manufacturing cost thereof can be significantly reduced. In addition, since the assembly between the switch 44 and the carrier body 41 of the carrier 40 and between the carrier 4 and the support member 30 are relatively simple, the switch 44 can be conveniently and quickly assembled in the receiving groove 424 of the carrier body 41, and the carrier 40 can be conveniently and quickly assembled to the support member 30. Through this, the assembly convenience of the electronic apparatus 100 can be significantly enhanced and the assembly time thereof can be significantly reduced.

Referring back to FIGS. 2, 4 and 6, when the first end surfaces 415 of the sliding blocks 412 abut against the abutment surface 332 of the support base 33, the switch assembly 4 is placed in the first position. At this time, the first contact point 431 of the column 43 protrudes through the first opening 111 of the frame 11. As such, the first contact point 431 is pushed by the first cover body 12 when the latter is assembled to the frame 11 to move the switch assembly 4 in the first direction (I) (see FIG. 7). In addition, when the pushbutton 443 is in the initial position, the second contact point 440 of the pushbutton 443 is spaced apart from the first contact point 431, so that the switch assembly 4 is placed in the OFF state.

Referring back to FIGS. 2, 6 and 7, to assemble the first and second cover bodies 12, 14 to the frame 11, if the first cover body 12 is first assembled to the frame 11, since the first contact point 431 protrudes through the first opening 111, when the first cover body 12 covers the first opening 111 of the frame 11, the first cover body 12 can push the first contact point 431 to move upward along the first direction (I) until the hook ends 335 of the retaining hooks 333 respectively abut and stop the second end surfaces 416 of the sliding blocks 412 to thereby position the switch assembly 4 at the second position. During sliding movement of the switch assembly 4 from the first position to the second position, because the second contact point 440 of the pushbutton 443 is unblocked, the pushbutton is remained in the initial position and the switch assembly 4 is remained in the OFF state. With the switch assembly 4 in the OFF state, electric shock can be prevented, so that the repair person can safely assemble the second cover body 13 to the frame 11.

Referring back to FIGS. 2, 6 and 8, if the second cover body 13 is first assembled to the frame 11, since the switch assembly 4 is in the first position and the first contact point 431 is unblocked, when the second cover body 13 covers the second opening 112 of the frame 11, the second cover body 13 is in contact with the second contact point 440, but does not push the latter. Because the second cover body 13 does not push the second contact point 440, the pushbutton 443 is remained in the initial position and the switch assembly 4 is remained in the OFF state. With the switch assembly 4 in the OFF state, electric shock can be prevented, so that the repair person can safely assemble the first cover body 12 to the frame 11.

Referring to FIG. 9, in combination with FIGS. 2 and 7, when the first cover body 12 is first assembled to the frame 11, the switch assembly 4 is positioned at the second position, and the second contact point 440 of the pushbutton 443 protrudes through the second opening 112 of the frame 11. Afterwards, the second cover body 13 is assembled to the frame 11, during which the second cover body 13 pushes down the second contact point 440 to move the pushbutton 443 downward along the second direction (II). As the pushbutton 443 continuously moves downward, it will compress the spring 444 so that the spring 444 is deformed and stores a restoring force. At this time, the pushbutton 443 is moved to the pressed position and the second contact point 440 is moved toward the first contact point 431. Thus, the switch assembly 4 is switched from the OFF state to the ON state, and the circuit board 31 is changed from a de-energized state to an energized state. In contrast, when the second cover body 13 is first assembled to the frame 11, the second cover body 13 abuts against the second contact point 440 of the pushbutton 443 so that the second contact point 440 is blocked by the second cover body 13. Afterwards, the first cover body 12 is assembled to the frame 11, during which the first cover body 12 pushes the first contact point 431 to move the column 43 upward along the first direction (I). Since the second cover body 13 blocks the second contact point 440, as the column 43 moves upward, the switch body 441 is pushed to move upward relative to the pushbutton 443 along the first direction (I) so as to compress the spring 444 so that the spring 444 is deformed and stores a restoring force. When the hook ends 335 of the retaining hooks 333 abut and stop the second end surfaces 416 of the respective sliding blocks 412, the switch assembly 4 is positioned at the second position, and the pushbutton 443 is in the pressed position. As such, the switch assembly 4 is switched from the OFF state to the ON state, and the circuit board 31 is changed from the de-energized state to the energized state.

Figure 10:
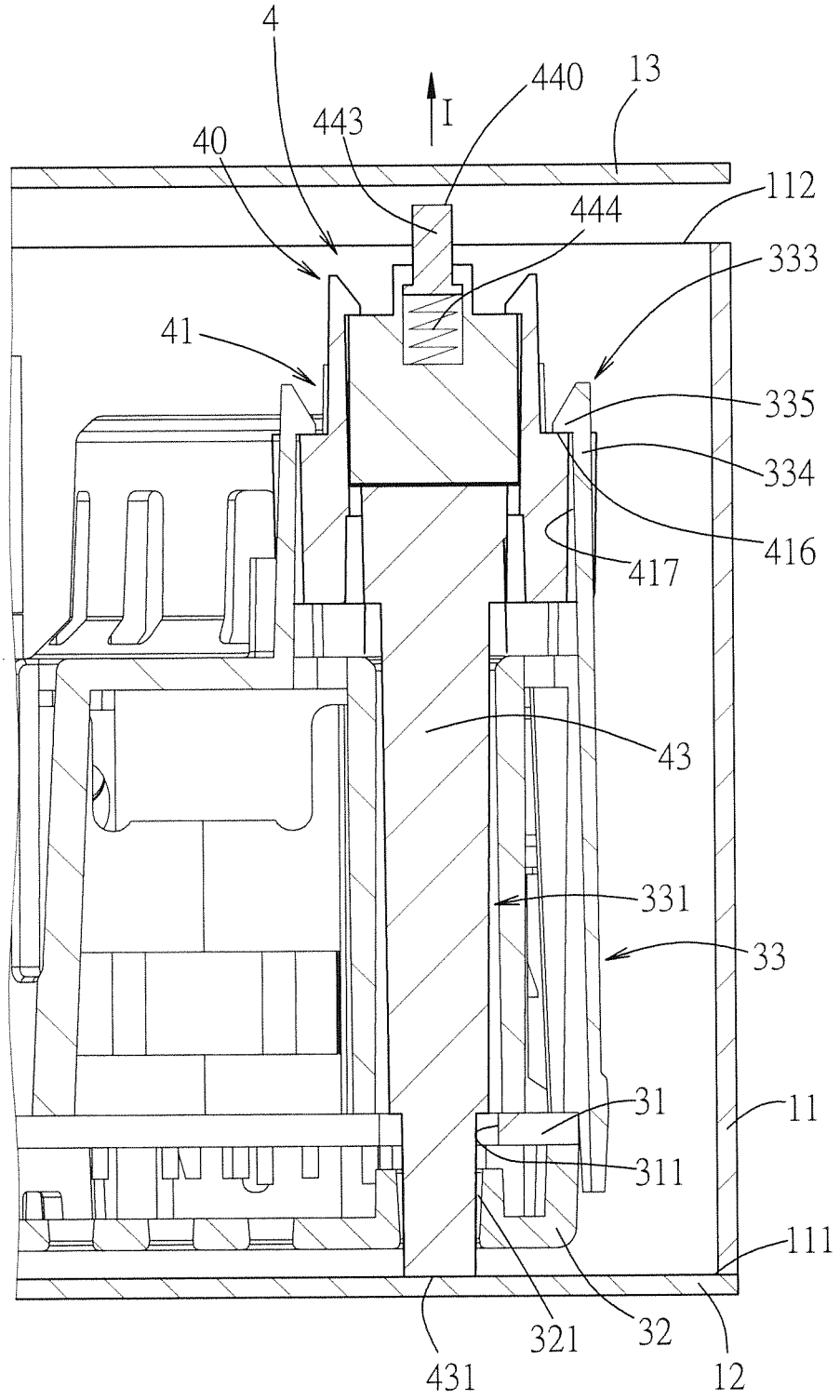
FIG. 10 is a view similar to FIG. 9, but with the second cover body being moved away from the second contact point and the pushbutton being restored to the initial position to switch the switch assembly to the OFF state.

As shown in FIGS. 9 and 10, when the repair person intends to inspect, repair or replace the electronic components on a top surface of the circuit board 31, the second cover body 13 is detached from the frame 11 so as to move away from the second contact point 440. When the second cover body 13 and the second contact point 440 are separated, the pushbutton 443 is restored to the initial position by the restoring force of the spring 444, and the second contact point 440 is moved away from the first contact point 431 so as to switch the switch assembly 4 from the ON state to the OFF state, and the circuit board 31 is changed from the energized state to the de-energized state. Through this, the repair person can safely inspect, repair or replace the electronic components on the top surface of the circuit board 31 through the second opening 112 of the frame 11.

Figure 11:
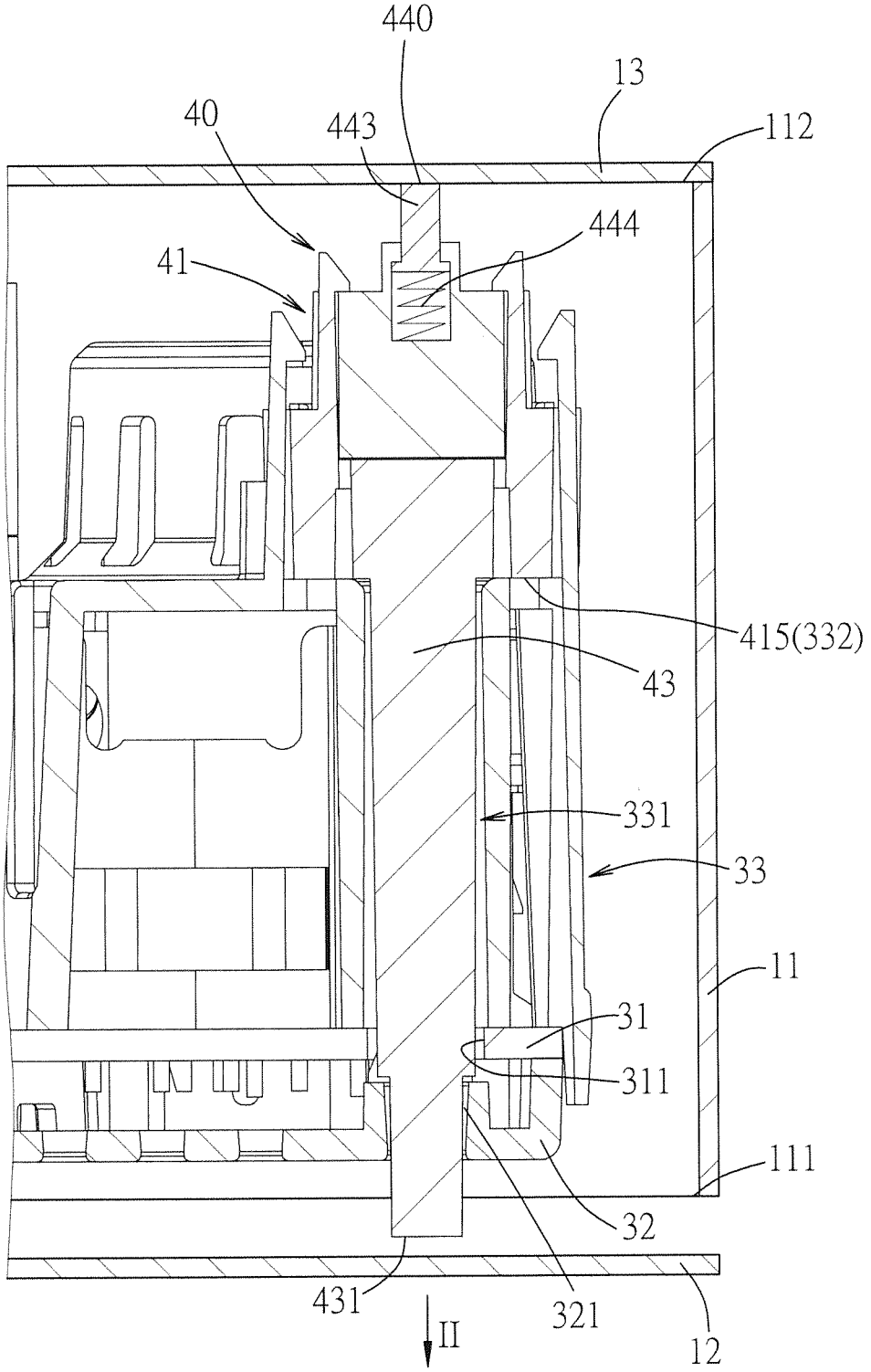
FIG. 11 is a view similar to FIG. 9, but with the first cover body being moved away from the first contact point and the pushbutton being restored to the initial position to move the switch assembly to the first position and the OFF state.

On the other hand, as shown in FIGS. 9 and 11, when the repair person intends to inspect, repair or replace the electronic components on a bottom surface of the circuit board 31, the first cover body 12 is detached from the frame 11 so as to move away from the first contact point 431. When the first cover body 13 and the first contact point 431 are separated, the carrier 40 and the switch body 441 are moved along the second direction (II) due to gravity and the restoring force of the spring 444. When the first end surfaces 415 of the sliding blocks 412 abut against the abutment surface 332 of the support base 33, the switch assembly 4 is positioned at the first position, the pushbutton 443 is in the initial position, and the first contact point 431 is moved away from the second contact point 440. As such, the switch assembly 4 is switched from the ON state to the OFF state, and the circuit board 31 is changed from the energized state to the de-energized state. Through this, the repair person can safely inspect, repair or replace the electronic components on the bottom surface of the circuit board 31 through the first opening 111 of the frame 11.

To sum up, through the switch assembly 4 of the switch device 2 which can be moved in two different directions so as to be switchable between the ON state and the OFF, the safety of operation and use of the electronic apparatus 100 can be enhanced, so that the repair person can safely assemble or disassemble the first and second cover bodies 12, 13. In addition, since the switch device 2 and the switch assembly 4 have few components and a simple structure, and are easy to assemble, the manufacturing cost and the assembly time thereof can be significantly reduced, and the convenience of assembly thereof can be significantly enhanced. Therefore, the object of the disclosure can be realized.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. An electronic apparatus comprising:

a housing including a first cover body for covering a first end thereof, and a second cover body opposite to said first cover body for covering a second end of said housing which is opposite to said first end; and a switch device disposed in said housing and including a support assembly including a support member, and a switch assembly mounted on and slidable relative to said support member and having a sliding portion slidably connected to said support member, a first contact point pushable by said first cover body, and a second contact point opposite to said first contact point and pushable by said second cover body, said switch assembly being slidable relative to said support assembly in a first direction and a second direction opposite to said first direction, and being switchable between OFF and ON states;

wherein, when said first cover body covers said first end of said housing and pushes said first contact point to move along said first direction with said second contact point being unblocked, or when said second cover body covers said second end of said housing and pushes said second contact point to move along said second direction with said first contact point being unblocked, said switch assembly is placed in said OFF state; and wherein, when said first and second cover bodies respectively and simultaneously cover said first end and said second end of said housing, said first and second contact points are pushed toward each other to switch said switch assembly from said OFF state to said ON state.

2. The electronic apparatus as claimed in claim 1, wherein said first and second contact points are spaced apart from each other when said switch assembly is in said OFF state.

3. The electronic apparatus as claimed in claim 2, wherein said support member has an abutment surface, said sliding portion having at least one first end surface, said switch assembly being slidable between a first position, where said at least one first end surface abuts against said abutment surface, and a second position, where said at least one first end surface is away from said abutment surface.

4. The electronic apparatus as claimed in claim 3, wherein said housing further includes a frame disposed between said first and second cover bodies and having said first and second ends of said housing, said frame defining a receiving space that receives said switch device, and having a first opening at said first end for communicating said receiving space with an outside environment, and a second opening at said second end for communicating said receiving space with the outside environment, said first contact point protruding through said first opening when said switch assembly is in said first position, said second contact point protruding through said second opening when said switch assembly is in said second position.

5. The electronic apparatus as claimed in claim 3, wherein said switch assembly includes a carrier and a switch disposed on said carrier, said carrier having said sliding portion and said first contact point, said switch including a pushbutton having said second contact point, and a spring to bias said pushbutton away from said first contact point for maintaining said switch assembly in said OFF state.

6. The electronic apparatus as claimed in claim 5, wherein said support member includes two retaining hooks disposed on two opposite sides of said abutment surface, each of said retaining hooks having an elongated guide arm portion, said sliding portion including two sliding blocks each of which defines an elongated sliding groove receiving said elongated guide arm portion of a respective one of said retaining hooks such that each of said sliding blocks is slidable relative to said elongated guide arm portion of the respective one of said retaining hooks, said elongated guide arm portions of said retaining hooks and said elongated sliding grooves of said sliding blocks being elongated in a direction parallel with said first and second directions.

7. The electronic apparatus as claimed in claim 6, wherein said at least one first end surface includes two said first end surfaces, each of said sliding blocks having a respective one of said first end surfaces, and a second end surface opposite to the respective one of said first end surfaces, said elongated sliding groove of each of said sliding blocks being formed between said second end surface and the respective one of said first end surfaces, said elongated guide arm portions of said retaining hooks respectively projecting from said two opposite sides of said abutment surface, each of said retaining hooks further having a hook end formed on a terminal end of a respective one of said elongated guide arm portions for abutting and stopping said second end surface to thereby position said switch assembly at said second position.

8. The electronic apparatus as claimed in claim 7, wherein said hook end of each of said retaining hooks has an inclined guide surface for abutting and guiding a respective one of said sliding blocks during mounting of said switch assembly on said support member.

9. The electronic apparatus as claimed in claim 7, wherein said support member defines a longitudinal axis, and includes a support base having said abutment surface, and an axially extending guide hole extending through said abutment surface, said carrier including a carrier body and a column, said carrier body including a base wall supporting said switch, and two positioning hooks, said sliding blocks being respectively formed on two opposite sides of said base wall, said positioning hooks respectively protruding from said second end surfaces of said sliding blocks and engaging said switch, said column projecting from said base wall opposite to said positioning hooks and having said first contact point, said column being inserted into said axially extending guide hole to extend said first contact point out of said support base.

10. The electronic apparatus as claimed in claim 9, wherein each of said positioning hooks includes a positioning arm portion protruding from said second end surface of a respective one of said sliding blocks, and a positioning hook end formed on a terminal end of said positioning arm portion and engaging said switch, said positioning hook end of each of said positioning hooks having an inclined surface for abutting and guiding said switch during mounting of said switch on said carrier.

11. The electronic apparatus as claimed in claim 9, wherein said carrier body further includes a first surrounding wall connected to said base wall and said sliding blocks, and a second surrounding wall connected to said sliding blocks opposite to said first surrounding wall and spaced apart from said base wall, wherein said base wall, said sliding blocks, and said first and second surrounding walls cooperatively define a receiving groove for receiving said switch, and wherein said base wall, said sliding blocks, and said second surrounding wall cooperatively define an opening communicating with said receiving groove, said switch further including a transmission line extending out of said receiving groove through said opening.

12. A switch device of an electronic apparatus which includes opposite first and second cover bodies, said switch device comprising:

a support assembly including a support member; and a switch assembly mounted on and slidable relative to said support member and having a sliding portion slidably connected to said support member, a first contact point configured to be pushed by the first cover body, and a second contact point opposite to said first contact point and configured to be pushed by the second cover body, said switch assembly being slidable relative to said support assembly in a first direction and a second direction opposite to said first direction, and being switchable between OFF and ON states, wherein, when said first contact point is pushed by the first cover body to move along said first direction with said second contact point being unblocked, or when said second contact point is pushed by the second cover body to move along said second direction with said first contact point being unblocked, said switch assembly is placed in said OFF state, and wherein, when said first and second contact points are respectively and simultaneously pushed by the first and second cover bodies, said first and second contact points are pushed toward each other to switch said switch assembly from said OFF state to said ON state.

13. The switch device of the electronic apparatus as claimed in claim 12, wherein said first and second contact points are spaced apart from each other when said switch assembly is in said OFF state.

14. The switch device of the electronic apparatus as claimed in claim 13, wherein said support member has an abutment surface, said sliding portion having at least one first end surface, said switch assembly being slidable between a first position, where said at least one first end surface abuts against said abutment surface, and a second position, where said at least one first end surface is away from said abutment surface.

15. The switch device of the electronic apparatus as claimed in claim 14, wherein said switch assembly includes a carrier and a switch disposed on said carrier, said carrier having said sliding portion and said first contact point, said switch including a pushbutton having said second contact point, and a spring to bias said pushbutton away from said first contact point for maintaining said switch assembly in said OFF state.

16. The switch device of the electronic apparatus as claimed in claim 15, wherein said support member includes two retaining hooks disposed on two opposite sides of said abutment surface, each of said retaining hooks having an elongated guide arm portion, said sliding portion including two sliding blocks each of which defines an elongated sliding groove receiving said elongated guide arm portion of a respective one of said retaining hooks such that each of said sliding blocks is slidable relative to said elongated guide arm portion of the respective one of said retaining hooks, said elongated guide arm portions of said retaining hooks and said elongate sliding grooves of said sliding blocks being elongated in a direction parallel with said first and second directions.

17. The switch device of the electronic apparatus as claimed in claim 16, wherein said at least one first end surface includes two said first end surfaces, each of said sliding blocks having a respective one of said first end surfaces, and a second end surface opposite to the respective one of said first end surfaces, said elongated sliding groove of each of said sliding blocks being formed between said second end surface and the respective one of said first end surfaces, said elongated guide arm portions of said retaining hooks respectively projecting from said two opposite sides of said abutment surface, each of said retaining hooks further having a hook end formed on a terminal end of a respective one of said elongated guide arm portions for stopping said second end surface to thereby position said switch assembly at said second position.

18. The switch device of the electronic apparatus as claimed in claim 17, wherein said hook end of each of said retaining hooks has an inclined guide surface for abutting and guiding a respective one of said sliding blocks during mounting of said switch assembly on said support member.

19. The switch device of the electronic apparatus as claimed in claim 17, wherein said support member defines an axis, and includes a support base having said abutment surface, and an axially extending guide hole extending through said abutment surface, said carrier including a carrier body and a column, said carrier body including a base wall supporting said switch, and two positioning hooks, said sliding blocks being respectively formed on two opposite sides of said base wall, said positioning hooks respectively protruding from said second end surfaces of said sliding blocks and engaging said switch, said column projecting from said base wall and having said first contact point, said column being inserted into said axially extending guide hole to extend said first contact point out of said support base.

20. The switch device of the electronic apparatus as claimed in claim 19, wherein each of said positioning hooks includes a positioning arm portion protruding from said second end surface of a corresponding one of said sliding blocks, and a positioning hook end formed on a terminal end of said positioning arm portion and engaging said switch, said positioning hook end of each of said positioning hooks having an inclined surface for abutting and guiding said switch during mounting of said switch on said carrier.

21. The switch device of the electronic apparatus as claimed in claim 19, wherein said carrier body further includes a first surrounding wall connected to said base wall and said sliding blocks, and a second surrounding wall connected to said sliding blocks opposite to said first surrounding wall and spaced apart from said base wall, wherein said base wall, said sliding blocks, and said first and second surrounding walls cooperatively define a receiving groove for receiving said switch, and wherein said base wall, said sliding blocks, and said second surrounding wall cooperatively define an opening communicating with said receiving groove, said switch further including a transmission line extending out of said receiving groove through said opening.

22. A switch assembly of a switch device comprising:

a carrier including a sliding portion and a first contact point; and a switch disposed on said carrier and including a second contact point opposite to said first contact point;

wherein said switch is movable along with said carrier in a first direction and a second direction opposite to said first direction; and wherein said switch assembly is placed in an OFF state when said first and second contact points are moved away from each other, and is switched from said OFF state to an ON state when said first and second contact points are moved toward each other.

23. The switch assembly as claimed in claim 22, wherein said switch further includes a pushbutton having said second contact points, and a spring to bias said pushbutton away from said first contact point for maintaining said switch assembly in said OFF state.

24. The switch assembly as claimed in claim 22, wherein said carrier includes a carrier body and a column, said carrier body including abase wall supporting said switch, said sliding portion including two sliding blocks respectively formed on two opposite sides of said base wall, each of said sliding blocks defining an elongated sliding groove elongated in a direction parallel with said first and second directions, said column projecting from said base wall and having said first contact point.

25. The switch assembly as claimed in claim 24, wherein each of said sliding blocks has a first end surface and a second end surface opposite to said first end surface, said elongated sliding groove being formed between said first and second end surfaces, said carrier body further including two positioning hooks respectively protruding from said second end surfaces of said sliding blocks and engaging said switch.

26. The switch assembly as claimed in claim 24, wherein each of said positioning hooks includes a positioning arm portion protruding from said second end surface of a corresponding one of said sliding blocks, and a positioning hook end formed on a terminal end of said positioning arm portion and engaging said switch, said positioning hook end of each of said positioning hooks having an inclined surface for abutting and guiding said switch during mounting of said switch on said carrier.

27. The switch assembly as claimed in claim 24, wherein said carrier body further includes a first surrounding wall connected to said base wall and said sliding blocks, and a second surrounding wall connected to said sliding blocks opposite to said first surrounding wall and spaced apart from said base wall, wherein said base wall, said sliding blocks, said first and second surrounding walls cooperatively define a receiving groove for receiving said switch, and wherein said base wall, said sliding blocks, and said second surrounding wall cooperatively define an opening communicating with said receiving groove, said switch further including a transmission line extending out of said receiving groove through said opening.

* * * * *